United States Patent [19]

Schnirch et al.

[11] Patent Number: 4,536,163

[45] Date of Patent: Aug. 20, 1985

[54] MECHANISM FOR VERTICALLY MOVABLY SUPPORTING A BOARD MEMBER ON A WALL

[75] Inventors: Leo Schnirch; Karl-Hermann Weyel, both of Haiger, Fed. Rep. of Germany

[73] Assignee: Weyel KG Visuelle Einrichtungen, Haiger, Fed. Rep. of Germany

[21] Appl. No.: 545,541

[22] Filed: Oct. 26, 1983

[30] Foreign Application Priority Data

Oct. 26, 1982 [DE] Fed. Rep. of Germany ..... 3239502

[51] Int. Cl.[3] ..... B43L 1/04

[52] U.S. Cl. ..... 434/420

[58] Field of Search ..... 434/420, 421, 408, 413; 248/492, 495; 52/29

[56] References Cited

U.S. PATENT DOCUMENTS

| | | | |
|---|---|---|---|
| 579,767 | 3/1897 | Mushoff | 434/420 |
| 604,422 | 5/1898 | Schneider | 434/420 |
| 1,394,572 | 10/1921 | Neil | 434/420 |
| 3,037,301 | 6/1962 | Siepel | 434/420 |
| 3,269,035 | 8/1966 | Bong | 434/420 |

FOREIGN PATENT DOCUMENTS

| | | | |
|---|---|---|---|
| 441738 | 6/1912 | France | 434/413 |

*Primary Examiner*—Harland S. Skogquist

*Attorney, Agent, or Firm*—Flynn, Thiel, Boutell & Tanis

[57] ABSTRACT

A wall board includes a board support mechanism which is adapted to be secured to a vertical wall surface and a board member which is vertically movably supported on the board support mechanism. The board support mechanism includes an arrangement which counterbalances the weight of the board member. Laterally spaced, vertically extending side walls extend rearwardly from the board member on opposite sides of the board support mechanism to locations adjacent the vertical wall surface. The inner sides of the side walls have vertically extending guide rails which receive guide slides or guide rollers provided on the board support mechanism.

20 Claims, 7 Drawing Figures

MECHANISM FOR VERTICALLY MOVABLY SUPPORTING A BOARD MEMBER ON A WALL

FIELD OF THE INVENTION

This invention relates to a wall board and, more particularly, to a wall board which includes a stationary board support which can be secured on a wall and a board member which is vertically adjustable relative to the board support and has a surface adapted for writing or some other use, for example an information or project surface.

BACKGROUND OF THE INVENTION

In known wall boards of this type, the board member is arranged in front of the board support, so that the latter is visible from the side. The board member has, optically, no connection to the wall surface. In this arrangement, the board support mechanism is exposed to much dirt and dust. Also, breakdowns can occur due to solid articles, for example drawing utensils, getting into the board support and blocking the board support mechanism. Also, the danger of injuries exists, since manual reaching into the board support mechanism is possible, whereby in particular injuries to the hand are to be feared. Finally, the appearance of the known boards is also not pretty, since an optical connection of the board member to the wall surface does not exist and the board member, because of its elevational adjustability, is in a changing three-dimensional arrangement with respect to the board support.

A basic purpose of the invention is thus to provide a wall board of the above-mentioned type in which the board support is not visible, so that the mentioned disadvantages are avoided.

This purpose is attained according to the invention by providing vertical side walls on the board member which project rearwardly from the back of the board member and extend along or near the side edges of the board member, and by arranging guide rails on the inner sides of these side walls, which guide rails receive guide slide pieces or guide rollers provided on the board support, the side walls covering the board support laterally and extending approximately to the wall.

In a thusly constructed wall board, the board support mechanism is covered by the side walls and thus is not visible. Due to the side walls extending rearwardly to a location close to the wall, there exists optically a connection of the board member to the wall, which substantially improves the appearance of the wall board. Manually reaching into the board support mechanism from the side is not possible, through which the danger of injuries is reduced. Also, falling of solid articles into the board support mechanism is not possible. A board according to the invention is particularly suitable for use in presentation rooms, for example conference rooms. However, it is also suitable for many other uses, for example for equipping schools.

The wall board advantageously has a weight balancing device which is arranged on the board support and includes a counterweight or at least a counterspring. A conventional balancing device can be utilized here, which device is of the type usually used for school wall boards and can be provided in a wall board support. A special embodiment for such a balancing device involves a counterweight which moves in a direction opposite to the board. However, one can also achieve a weight balance through a spring force, whereby during lowering of the board, energy is stored in the spring and, during lifting of the board, energy is recovered from the spring. In a balancing device with a counterweight, resilient stops are advantageous in order to avoid hard impacts of the counterweight at the end positions.

In a preferred embodiment of the invention, each side wall and the guide rail associated with it are manufactured as one piece, preferably as an extrusion of aluminum. Through this, one obtains low manufacturing costs, particularly in the case of a series manufacture on a large scale. Also, arrangements within the scope of the invention include, for example, plates used as side walls and guide rails which are separate parts connected to the plates. The guide rails can have a U-shaped or C-shaped cross section. Such guide rails have the advantage that guide slide pieces and guide rollers are guided toward several sides, and in the case of a C-shaped cross section a lateral moving out of the rollers from the guide rail is not possible.

Important advantages are achieved if just side walls are provided. According to a preferred embodiment, however, walls are also provided above and below the board support. For the protection of the board support mechanism, it is particularly important to provide the upper wall, since it provides protection from dust and solid articles falling from above.

However, a lower wall also improves the wall board, because manually reaching into the board mechanism from below is no longer possible. In the case of two side walls, an upper wall and a lower wall, the board frame is completely surrounded by walls and thus protected all around.

The upper wall and the lower wall can also be extrusions, which are advantageously constructed as hollow profiles. A different profile than that used for the side walls is advisable because the horizontal walls do not need to have guide rails.

The walls are connected advantageously by means of corner pieces. The use of such corner pieces avoids the need for mitre cuts. Also, an advantageous shape is possible, since the special corner pieces permit a rounding of the corner regions.

The corner pieces are preferably constructed so that, during mounting of the board, the horizontal walls can be initially left out and then, after mounting of the board member on the board support mechanism, can be quickly mounted and can be secured in place by means of longitudinal screws. Also, the longitudinal screws can be made invisible by providing a cover plate thereover.

For a weight balancing device in which the balancing weight covers a vertical path which is as long as the vertical path of the board, the height of the board support is preferably approximately half that of the board member. The entire vertical path of movement of the board member is then approximately half the height of the board surface. However, constructions are also possible in which the height of the board support is less in relationship to the height of the board member. Such constructions are possible where the counterweight moves a smaller distance than the board member or where a weight balancing device with springs is used. In this case, the possible path of movement of the board member can be greater than half the height of the board surface. Particularly suitable and optically appealing is a square board member, even though this shape is not essential for realizing the invention.

BRIEF DESCRIPTION OF THE DRAWINGS

One exemplary embodiment of the invention is illustrated in the drawings, in which.

DETAILED DESCRIPTION

Figure 1:
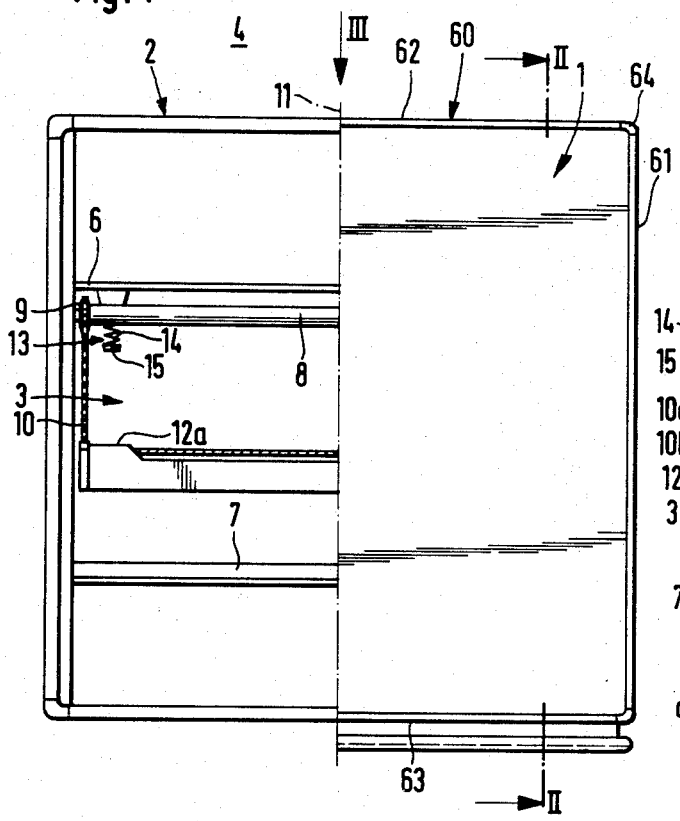
FIG. 1 is a fragmentary diagrammatic front view of a wall board embodying the invention, wherein the left half of the board member is cut away.

The wall board includes a board member 1, a frame 2 which is secured by clevis type connectors 1*a* on and projects rearwardly from the back side of the board member 1, and a board support 3. The structure and the cooperation of these main parts, and of further parts of the wall board, will be described hereinafter.

The board support 3 is secured in a conventional manner on a wall surface 4. The board frame support has two vertical side members 5 which are connected by an upper horizontal member 6 and a similar lower horizontal member 7, the member 7 being arranged as a mirror-image of the horizontal member 6. A shaft 8 is supported rotatably in the side members 5. Near each such support region of the shaft 8, a sprocket wheel 9 is supported on and fixed against rotation with respect to the shaft 8, which results in identical rotation of both sprocket wheels 9, the shaft 8 thus serving as a synchronizing member.

A respective chain 10 extends over each sprocket wheel 9. For clarification purposes, it is remarked that the chain 10 which is visible in FIG. 1 is not the chain 10 which can be seen in FIG. 2. The chains 10 are arranged in a mirror-image relationship with respect to the vertical center plane 11 of the wall board. An end 10*a* of each chain 10 is connected to the frame 2, and the other end 10*b* is connected to a respective counterweight 12.

To avoid hard impacts at the ends of the range of movement, a resilient stop 13 is provided a little below and laterally offset from each sprocket wheel 9, and includes a helical compression spring 14 and a rubber buffer 15 which is provided on the compression spring 14.

Each spring 14 extends vertically and has its upper end secured in a conventional manner to the underside of the upper horizontal member 6 of the board frame 3. Each buffer 15 is supported on the lower end of a respective spring 14.

Guide rollers 16 are supported on the outer sides of the members 5 for rotation about respective horizontal axes. Four such guide rollers 16, arranged in pairs (see FIG. 2), are provided on each side member 5. These guide rollers 16 cooperate with a guide rail on the frame 2 which will be described in detail hereinafter.

The frame 2 has (see in particular FIG. 6) two side walls 17, an upper wall 18 and a lower wall 19. The walls 17 to 19 are all aluminum extrusions. The profile of the side walls 17 can best be recognized from FIG. 5. The profile has, viewed in cross section, as in FIG. 5, a long straight section 20, the ends of which are followed by sections 21 and 22 which are perpendicular to the section 20. A section 23 follows the section 21 perpendicular thereto, which section 23 is approximately parallel to the long section 20 and has at its outer end a screw channel 24. The section 22 merges into a bent section 25 which is parallel to the section 20 and in turn merges into a section 26 which is parallel to the section 22 and is offset rearwardly with respect to the section 22. A bent section 27 projects inwardly from the long section 20, and a screw channel 28 is provided on the end of the bent section 27. Furthermore, bent sections 29 and 30 project from the section 28, which sections 29 and 30, together with a portion of the section 20, form a guide rail of a C-shaped cross section in which the guide rollers 16 are received.

The upper wall 18 and the lower wall 19 are also extrusions of aluminum and are preferably identical. The cross-sectional profile thereof can be seen from FIG. 7.

Figure 7:
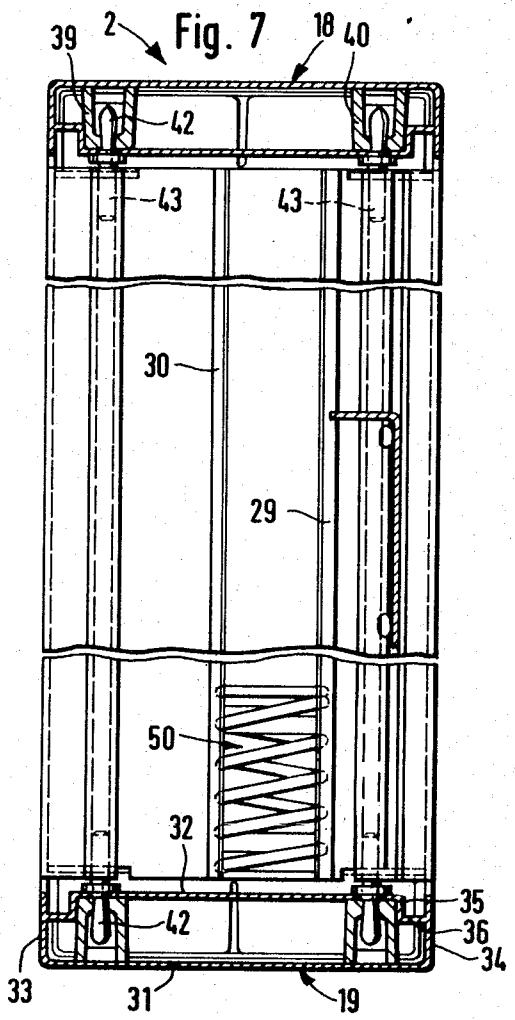
FIG. 7 is a diagrammatic sectional view of the frame of FIG. 6 taken along the line VII—VII of FIG. 6.

FIG. 7 shows that the walls 18 and 19 are hollow and of generally flat, rectangular cross section. Viewed in cross section, each of the walls 18 and 19 has two long parallel sections 31 and 32. Sections 33 and 34 are provided at the ends of the section 31 perpendicular thereto. The section 32 has at its ends two short, L-shaped intermediate sections 35 and 36 which intersect the sections 33 and 34. The sections 33 and 34 extend beyond the points at which they are connected to the sections 35 and 36, namely, they extend to the plane containing the long section 32.

The vertical side walls 17 are connected to the horizontal walls 18 and 19 by corner pieces 37. Each corner piece 37 has an elbow portion 38 which forms the corner region of the frame 2. Two extensions 39 and 40 which are parallel to one another (see FIG. 7) project from the elbow 38, which extensions 39 and 40 each have a generally U-shaped cross section. Furthermore, a short centering shoulder 41 projects from each corner piece 37.

Figure 6:
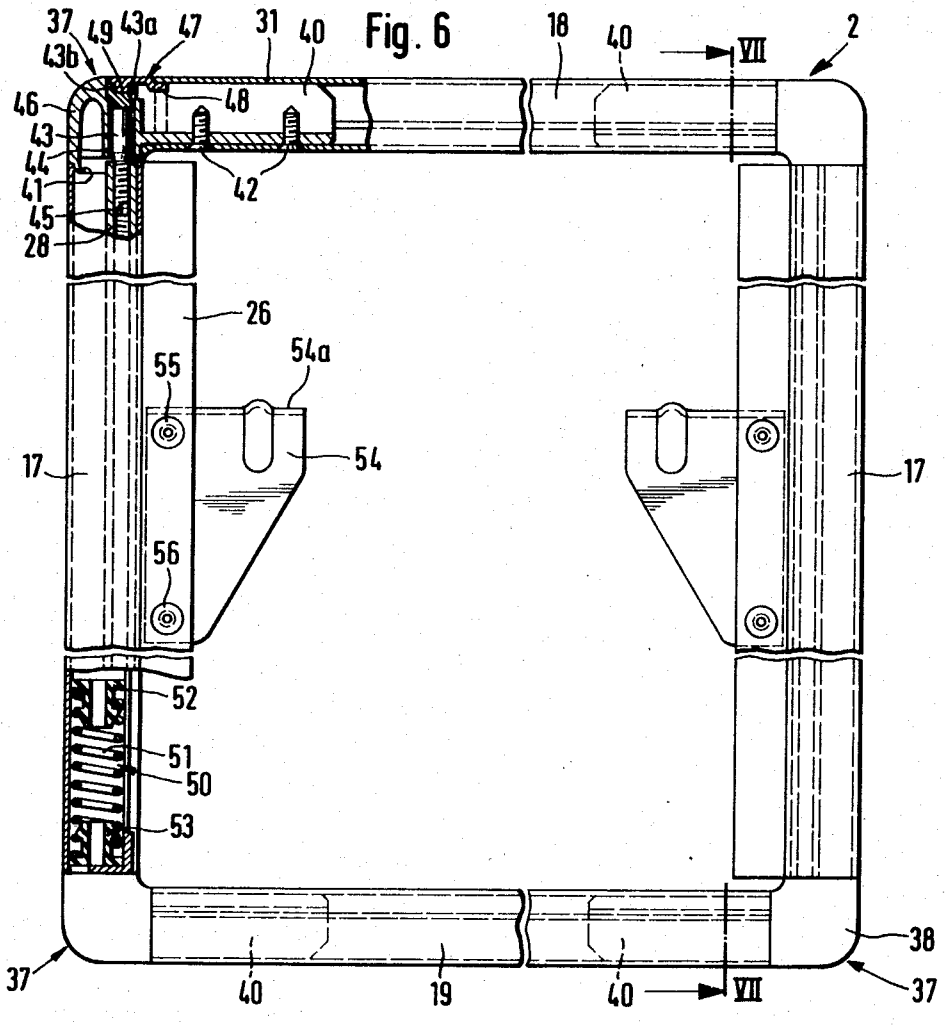
FIG. 6 is a fragmentary diagrammatic front view of a frame which is a component of the wall board of FIG. 1 and to which the board member is secured, wherein two corner regions of the frame are cut away.

As is shown in FIGS. 6 and 7, the connecting extensions 39, 40 are placed into a horizontal wall 18 or 19 and are secured thereto using screws 42. The corner piece 37 is at the same time properly aligned with the wall 18 or 19 by the engagement of the connecting extensions 39, 40 therein.

To connect the corner pieces 37 with the side walls 17, screws 43 are used. As is shown in FIG. 7, two such screws are arranged at each corner. Each screw extends through a respective opening 44 provided in the corner piece 37 and is screwed into a respective one of the screw channels 24 or 28 (see FIGS. 5 and 6). The screw cuts its own thread into the screw channel. To make penetration of the screw easier, it has a cutting edge 45. The screw has a cylindrical head 43*a* with a hexagonal recess 43*b*. The opening in the corner piece 37 for the screw 43 is counter-bored so that the screw head is set in relative to the outer surface 46 of the corner piece 37.

The opening through which the screw 43 is introduced is covered by a cover plate 47. The plate 47 has a shoulder 48 which grips under the panel 31 of the upper wall 18, and has a cylindrical shoulder or pin 49 which engages the hexagonal recess 43*b* in the screw 43.

The described construction of the frame 2 permits an installation such that first the side walls 17 are mounted on the board member 1 and then the wall board control mechanism is adjusted. The horizontal walls 18, 19 are mounted subsequently. The corner pieces 37 are already provided on these, which corner pieces 37 must then have their centering shoulders 41 moved into the vertical side walls 17. The screws 43 are then screwed in for fixing the walls 18 and 19 to the side walls 17.

Within the guide rail which is formed by the bent sections 29 and 30 of each side wall 17, a buffer which as a whole is identified with reference numeral 50 (FIG. 6) is provided, namely, at the lower end of the guide rail. The buffer 50 includes a compression spring 51, an upper rubber element 52 and a lower rubber element 53.

Figure 4:
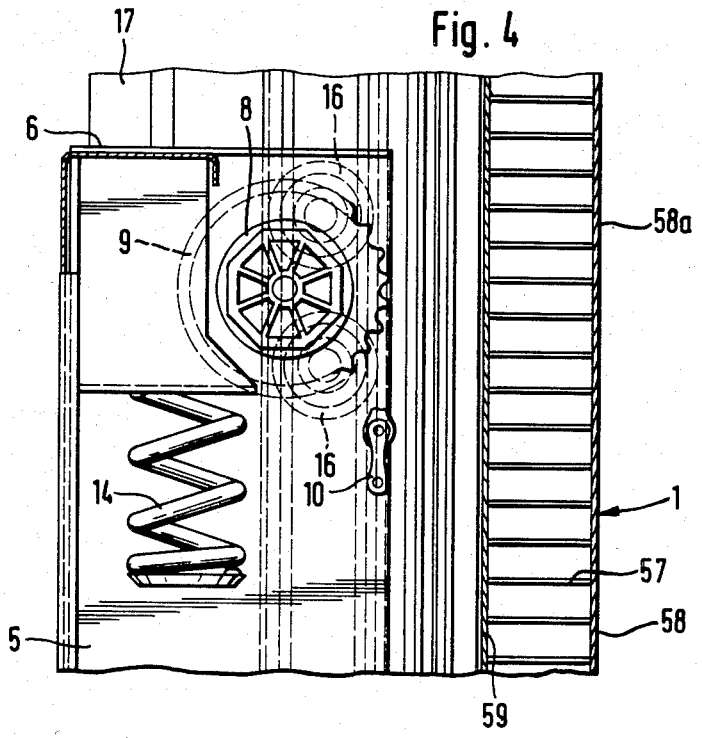
FIG. 4 is an enlarged diagrammatic sectional view of the portion of FIG. 2 designated by dash-dotted lines at IV in FIG. 2.

A bracket 54 is secured by means of rivets 55 and 56 on the profile section 26 of each side wall 17. The bracket 54 has an upper fastening surface 54*a* to which the end 10*a* of the associated chain 10 is fastened in a conventional manner. The board member 1 has (see for example FIG. 4) a core 57, which is preferably a honeycomb-like paper (so-called sulfate paper). A steel plate 58 is glued to the front side of the core 57 and a steel plate 59 is glued to the rear side. The edges of the board member 1 are defined by a frame 60 (FIG. 1), which has two side walls 61, an upper wall 62 and a lower wall 63. Here too, the vertical walls 61 and the horizontal walls 62 and 63 are connected by corner pieces 64. The visible side 58*a* (FIG. 4) of the front steel plate 58 forms the writing surface of the board.

Figure 2:
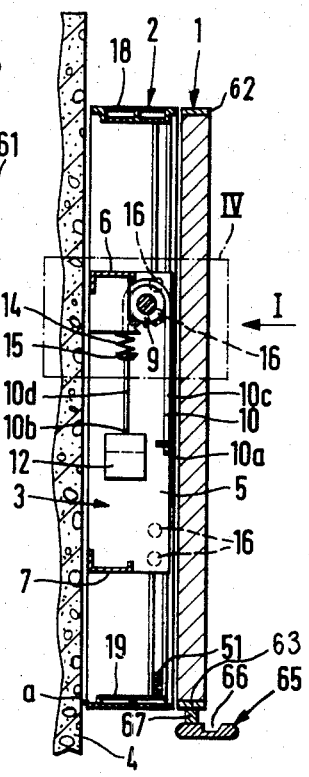
FIG. 2 is a diagrammatic sectional view taken along the line II—II of FIG. 1.
Figure 3:
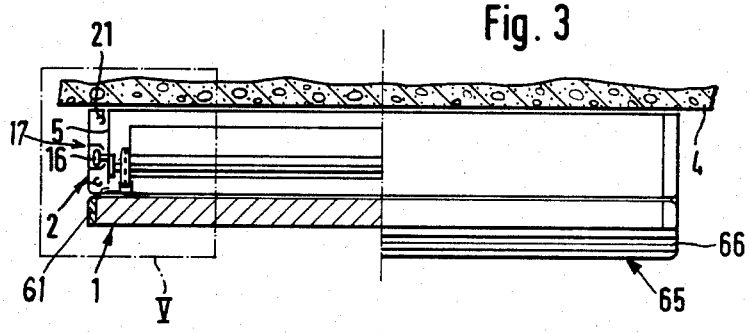
FIG. 3 is a fragmentary diagrammatic top view taken in the direction of the arrow III in FIG. 1.
Figure 5:
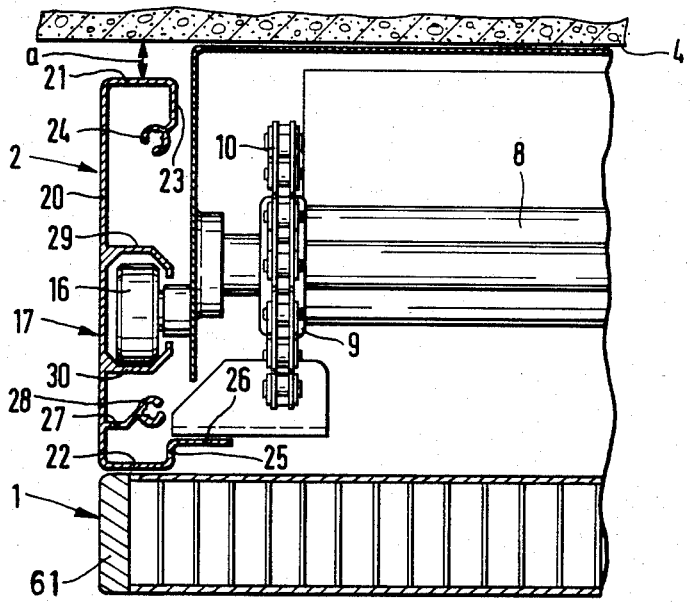
FIG. 5 is an enlarged diagrammatic sectional view of the portion of FIG. 3 designated by dash-dotted lines at V in FIG. 3.

As can be seen from FIGS. 3 and 5, the side surfaces of the board member 1 and the side walls 17 lie substantially in a common plane. The back side 21 of each side wall 17 is spaced a small distance a from the wall surface 4. This distance a is only large enough so that touching of the frame 2 and the wall surface 4 is avoided. Also, the upper wall 18 and the lower wall 19 are spaced from the wall surface 4 (see FIG. 2) by the distance a. The frame 2 thus completely surrounds the board support 3, so that access to the board support mechanism is not possible prior to removal of the walls of the frame 2.

FIGS. 1 and 2 illustrate a central vertical position of the board member. The board member can be moved both upwardly and also downwardly from this position. Each position is stable, because the weight of the board member 1 and the frame 2 is balanced by the counterweight 12. During an upward movement of the board member, the weight 12 is lowered, whereby the front stringer 10*c* of the chain 10 becomes shorter and the rear stringer 10*d* becomes longer. In the highest possible position, the buffers 50 are engaged by the lowermost rollers 16. Through this, any impact is dampened, so that hard impacts which could result in damage are avoided.

In the lowermost position of the board, the upper side 12*a* of the counterweight engages the resilient stop 13, so that in this end position a hard impact is also avoided. During vertical movement, the guide rollers 16 roll within the guide rails which are formed by the bent sections 29, 30 of the side walls 17. One roller of each pair of rollers is offset vertically and rearwardly with respect to the other, so that one of the rollers engages one side of the guide rail and the other roller engages the other side thereof. This is evident in FIG. 5 from the roller 16 which is visible there being guided only by the bent section 30. Through this, one achieves a clean rolling along and also an absolutely play-free guiding.

The board member 1 has a square shape, which is particularly becoming. Through the frame 2, an optical connection of the board member 1 to the wall surface 4 is achieved. The frames 2 and 60 have the same outside dimensions and merge steplessly into one another. Through this, one obtains a becoming outside appearance, so that the board is particularly suitable for presentation rooms, for example conference rooms.

Extending along the underside of the board member 1 is a storage shelf 65 which has a groove 66 in which writing utensils can be stored. The storage shelf 65 is connected to the board member 1 by an intermediate piece 67.

The invention has been discussed in connection with one exemplary embodiment in which the board surfaces are formed by steel plates. Instead of steel plate, it is also possible to utilize other thin plates, for example reinforced plastic plates (so-called laminated plastic plates).

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a wall board, including a stationary board support which can be secured on a wall and a board member which can be moved vertically relative to said board support, said board member having thereon a surface, the improvement comprising vertical side walls connected to said board member, projecting rearwardly from a back side of said board member, and extending adjacent side edges of said board member, wherein on inner sides of said side walls there are guide rails which receive guide-slide pieces provided on said board support, and wherein said side walls cover said board support laterally and extend approximately to the wall.

2. The wall board according to claim 1, including weight-balancing means which is arranged on said board support and is operatively coupled to said board member for counterbalancing the weight thereof so that said board member will remain in a selected vertical position.

3. The wall board according to claim 2, wherein said weight-balancing means includes a horizontal shaft which is rotatably supported on said board support and extends substantially the entire width thereof, two sprocket wheels which are supported on and fixed against rotation with respect to said shaft and which are arranged near the ends of said shaft, two chains which each have two ends and are each guided over a respective said sprocket wheel, and two counterweights, wherein one end of each said chain is coupled to said board member and the other end thereof is coupled to a respective said counterweight.

4. The wall board according to claim 3, including resilient stop means engageable with each said counterweight and arranged on said board support.

5. The wall board according to claim 1, wherein an integral portion of each said side wall is said guide rail thereon.

6. The wall board according to claim 1, wherein said guide rails each have a generally U-shaped cross section.

7. The wall board according to claim 1, including an upper horizontal wall which projects rearwardly from said back side of said board member and extends adjacent an upper edge of said board member, and wherein said upper wall covers said board support from above and extends approximately to the wall.

8. The wall board according to claim 7, including a lower horizontal wall which projects rearwardly from said back side of said board member and extends adjacent a lower edge of said board member, and wherein said lower wall covers said board support from below and extends approximately to the wall.

9. The wall board according to claim 8, wherein said upper wall and said lower wall are each made in one piece.

10. The wall board according to claim 9, wherein said upper and lower walls extend perpendicular to said side walls, and wherein said upper and lower walls have ends which are adjacent ends of said side walls, said adjacent ends of said side walls and said upper and lower walls being connected to one another by corner pieces which have centering parts extending into said upper lower and side walls and which each have an elbow part which has visible outer surfaces.

11. The wall board according to claim 10, wherein said corner pieces have fastening extensions which are connected to said upper and lower walls by transverse screws which extend transversely to said fastening extensions, while for connecting said corner pieces to said side walls, longitudinal screws which extend parallel to said side walls are used, said longitudinal screws extending through said corner pieces and being screwed into said side walls.

12. The wall board according to claim 11, wherein said lonqitudinal screws have heads which are each covered by a cover plate, each said cover plate having a pin which engages a recess in said head of the associated longitudinal screw, each said recess being hexagonal in shape.

13. The wall board according to claim 1, wherein the vertical height of said board support is approximately half the vertical height of said board member.

14. The wall board according to claim 1, wherein said board member is rectangular.

15. The wall board according to claim 1, wherein said guide slide pieces are guide rollers rotatably supported on said board support.

16. The wall board according to claim 4, wherein said resilient stop means includes at least one compression spring.

17. The wall board according to claim 5, wherein each said side wall is an aluminum extrusion.

18. The wall board according to claim 9. wherein said upper and lower walls are each a hollow aluminum extrusion having a substantially rectangular cross-section.

19. The wall board according to claim 11, wherein said side walls are each an aluminum extrusion having screw channels into which said longitudinal screws are screwed.

20. The wall board according to claim 1, wherein said guide rails each have a generally C-shaped cross-section.

* * * * *